US010896775B2

(12) United States Patent
Miyagawa et al.

(10) Patent No.: US 10,896,775 B2
(45) Date of Patent: Jan. 19, 2021

(54) RESISTOR

(71) Applicant: KOA CORPORATION, Nagano (JP)

(72) Inventors: Masaki Miyagawa, Nagano (JP); Kyohei Miyashita, Nagano (JP); Hiroshi Sakai, Nagano (JP); Hidekazu Karasawa, Nagano (JP); Takashi Ito, Nagano (JP)

(73) Assignee: KOA Corporation, Nagano (JP)

( * ) Notice: Subject to any disclaimer, the term of this patent is extended or adjusted under 35 U.S.C. 154(b) by 270 days.

(21) Appl. No.: 16/083,004

(22) PCT Filed: Feb. 20, 2017

(86) PCT No.: PCT/JP2017/006235
§ 371 (c)(1),
(2) Date: Sep. 7, 2018

(87) PCT Pub. No.: WO2017/154546
PCT Pub. Date: Sep. 14, 2017

(65) Prior Publication Data

US 2019/0066886 A1 Feb. 28, 2019

(30) Foreign Application Priority Data

Mar. 8, 2016 (JP) ..... 2016-045043

(51) Int. Cl.
*H01C 1/142* (2006.01)
*H01C 7/00* (2006.01)
*H01C 1/028* (2006.01)

(52) U.S. Cl.
CPC ..... *H01C 1/142* (2013.01); *H01C 1/028* (2013.01); *H01C 7/00* (2013.01)

(58) Field of Classification Search
CPC ..... H01C 1/032; H01C 1/034; H01C 1/142; H01C 1/144; H01C 1/146; H01C 17/22; H01C 17/02; H01C 1/084
See application file for complete search history.

(56) References Cited

U.S. PATENT DOCUMENTS 4,152,689 A * 5/1979 Thompson ..... H01C 1/028 338/226
4,788,524 A * 11/1988 Ozaki ..... H01C 17/02 338/195

(Continued)

FOREIGN PATENT DOCUMENTS

JP H03-29288 A 2/1991
JP H05-226106 A 9/1993

(Continued)

*Primary Examiner* — Kyung S Lee
(74) *Attorney, Agent, or Firm* — Carrier Blackman & Associates, P.C.; William D. Blackman; Joseph P. Carrier

(57) ABSTRACT

A resistor has a structure including a resistor substrate that has paired electrodes and a resistive element formed on an insulating substrate, an insulating exterior material that covers at least the upper and the side surface of the resistor substrate, and harness electric wires that have one end parts connected to the respective electrodes, pass through the exterior material, and extend outside. The paired electrodes are formed on areas other than the end parts of the insulating substrate, and junctions of the end parts of the harness electric wires and the paired electrodes are at positions where creepage distance of insulation from the junctions to the bottom ends of the insulating substrate is a predetermined distance or longer. Such structure provides the resistor having a secured creepage distance of insulation between the conductor parts of the resistor and the metal case in which the resistor is installed.

11 Claims, 8 Drawing Sheets

(56) References Cited

U.S. PATENT DOCUMENTS

| | | | | | |
|---|---|---|---|---|---|
| 5,252,944 | A * | 10/1993 | Caddock, Jr. | H01C 1/084 | 257/675 |
| 5,291,178 | A * | 3/1994 | Strief | H01C 1/084 | 257/675 |
| 5,304,977 | A | 4/1994 | Caddock, Jr. | | |
| 7,075,407 | B1 * | 7/2006 | Kawamoto | G01K 1/14 | 338/22 R |
| 2002/0118094 | A1 * | 8/2002 | Kambara | H01C 7/06 | 338/309 |

FOREIGN PATENT DOCUMENTS

| | | | |
|---|---|---|---|
| JP | H07-22201 | A | 1/1995 |
| JP | 2000-216001 | A | 8/2000 |
| JP | 2005-150567 | A | 6/2005 |
| JP | 2008-305985 | A | 12/2008 |

* cited by examiner

RESISTOR

TECHNICAL FIELD

The present invention relates to a power resistor for heat dissipation (high power resistor). In particular, it relates to a resistor used as an in-vehicle continuous discharge resistor.

BACKGROUND ART

The hybrid electric vehicle (HEV) that draws public attention as a vehicle compatible with the recent environment and energy issues has two different types of power sources and uses a high-voltage electrical storage device (battery) as a motor driving source, which is one of the power sources. Capacitors for smoothing and voltage stabilization are usually equipped in the power control unit (PCU) of the hybrid electric vehicle, and in addition a discharge resistor for consuming the electric charge continuously and slowly is equipped.

A film resistor designed to be mounted on a printed circuit board is disclosed in Patent Document 1, for example, as a power resistor (which is also referred to as mold resistor) used in high voltage and large current environments. The resistor of the Patent Document 1 has a structure in which trace-pad combined bodies 17 (equivalent to electrodes) are formed on the upper surface of a flat substrate (ceramic device) 13 and which tip part sections 23 of metal terminals (leads) 22 are joined to the respective combined bodies 17. Moreover, a resistance film 18 is formed on the combined bodies 17 on which a protective covering 19 is formed. The upper surface etc. except for the tip part sections 23 of these metal terminals 22 and the bottom 14 of the substrate 13 are embedded in a synthetic resin main body 10 having a long and slender, rectangular shape.

PRIOR ART DOCUMENTS

Patent Documents

Patent Document 1: JP Hei5-226106A (Japanese Patent No. 2904654)

DISCLOSURE OF THE INVENTION

Problem to be Solved by the Invention

The conventional mold resistor has a structure in which, like the resistor of the above-mentioned Patent Document 1, the tip part sections 23 of the metal terminals 22 are fixed to the rectangle electrodes (trace-pad combined bodies 17) arranged at the end parts of the substrate 13 using solder. Therefore, creepage distance of insulation between a metal case (e.g., aluminum die-casting) in which the resistor is installed and conductor sections (the electrodes and the metal terminals) of the resistor is not securable, resulting in a problem that insulation cannot be secured.

Especially, in the case of the in-vehicle resistor, a predetermined creepage distance of insulation between the conductor sections of the resistor and the metal case in which the resistor is installed is required to be maintained according to a public technical standard, such as "JIS C 60664 (IEC 60664): Insulation coordination for equipment within low-voltage systems". However, even if trying to secure insulation with the above-mentioned conventional electrode structure, there are the following problems. That is, it is impossible to secure a sufficient area for the resistive element in the resistor, and otherwise even if the area of the insulating substrate is made larger, it is impossible to miniaturize the respective parts.

The present invention is made in light of the problem mentioned above. An object of the invention is to provide a large electric power (high power) resistor, which secures a predetermined creepage distance of insulation between the conductor sections, such as electrodes formed in the resistor, and a metal case in which the resistor is installed.

Means of Solving the Problem

The following structure is provided as a means for attaining the above-mentioned object and solving the problem. That is, a resistor according to the present invention is characterized by including a resistor substrate that comprises paired electrodes and a resistive element formed on an insulating substrate, an insulating exterior material that covers at least the upper and the side surface of the resistor substrate, and a pair of externally connecting electric conductors that have one end parts connected to the respective paired electrodes, pass through the exterior material, and extend outside; wherein the paired electrodes are formed on areas other than the end parts of the insulating substrate, and junctions of the end parts of the paired externally connecting electric conductors and the paired electrodes are at positions where creepage distance of insulation from the junctions to the bottom ends of the insulating substrate is a predetermined distance or longer.

The predetermined distance is characterized by being the minimum distance that secures electric insulation between the junctions and an external conductor (e.g., a metal case made up of an aluminum die-cast etc.) touching the bottom of the insulating substrate, for example. Furthermore, the junctions are characterized by being convex parts, which are respective parts of the paired electrodes projecting inward of the insulating substrate, for example.

Yet further, the resistive element is characterized in that it is formed having a shape corresponding to shapes of the paired electrodes and straddling between the paired electrodes, for example. Yet further, the resistive element is characterized in that it is formed surrounding each of the outer circumferences of the paired electrodes, for example. Yet even further, the resistive element is characterized in that it has a spiral form without any corners, for example. Yet even further, the upper surface of the resistor substrate is characterized in that it is covered by the insulating protective film except for the junctions, for example. Yet even further, the paired externally connecting electric conductors are characterized by being flexible harness electric wires comprising leads covered by an insulating coating, for example.

Results of the Invention

A resistor according to the invention, which is suitable for continuous discharge resistors used in a vehicle by securing creepage distance of insulation between the conductor sections of the resistor and a metal case in which the resistor is installed as well as meeting requirements for low-profile, smaller resistor, may be provided.

BRIEF DESCRIPTION OF DRAWINGS

FIGS. 1A and 1B show external oblique views of a power resistor according to an embodiment, wherein FIG. 1A is an external oblique view of the resistor when viewed from the front, and FIG. 1B is an external oblique view of the resistor when viewed from the back;

FIGS. 5A-5C are illustrations showing example forms of electrodes and the resistive element for securing creepage distance of insulation in the resistor of the embodiment; wherein FIG. 5A illustrates the electrodes including convex parts having respective central parts projecting inward of the insulating substrate, FIG. 5B illustrates the electrodes having respective convex parts projecting inward of the insulating substrate, and FIG. 5C illustrates the electrodes having convex parts at one end parts of the electrodes that project inward of the insulating substrate;

FIGS. 8A-8B are illustrations showing a form of the resistive element according to a modification of the embodiment; that is, showing a an example of a resistive element pattern which allows adjustment (trimming) of the resistance; wherein FIG. 8A shows the resistor pattern before trimming, and FIG. 8B shows trimming is carried out by making a cut in a part of a resistive element;

DESCRIPTION OF EMBODIMENTS

Figure 1A:
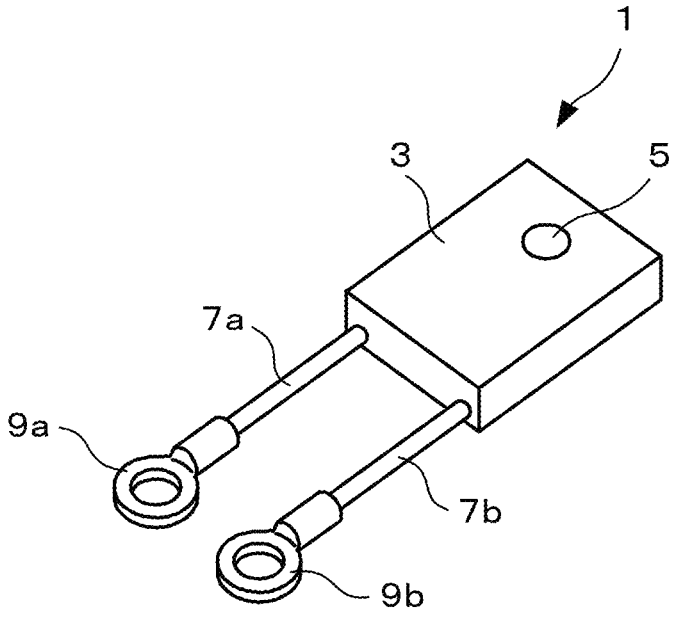
Figure 1B:
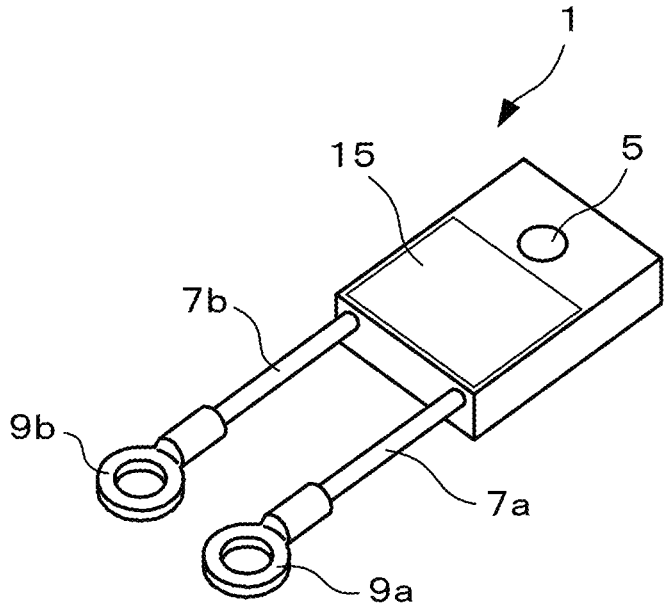
Figure 2:
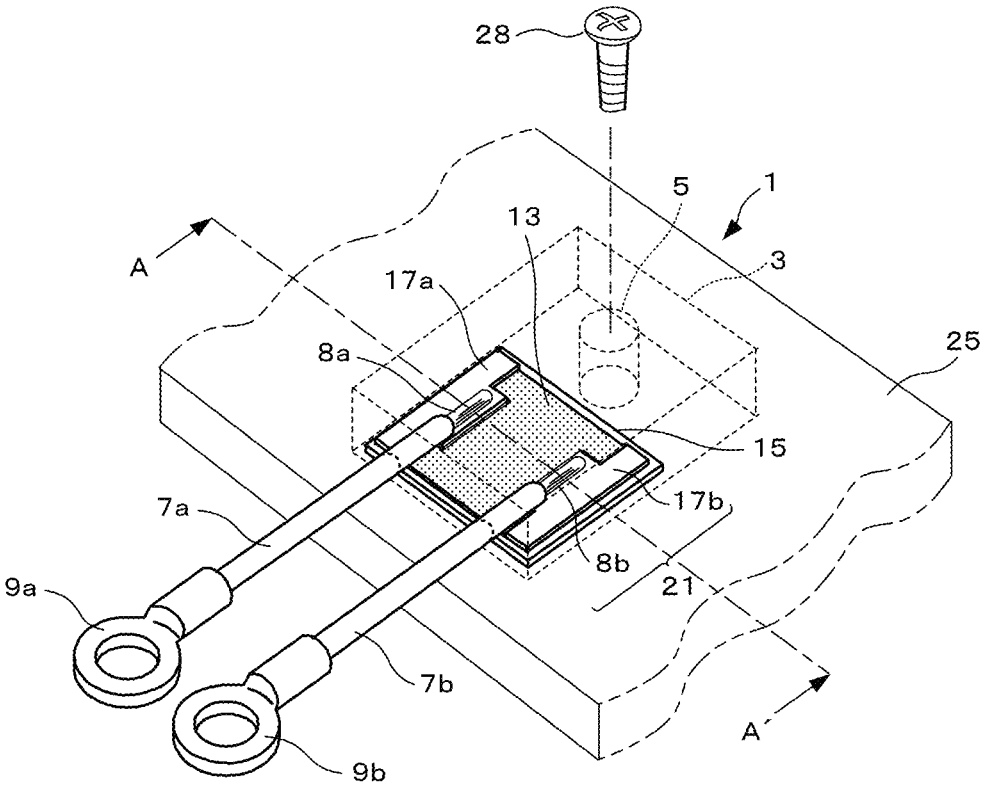
FIG. 2 is a perspective view showing an internal structure of the resistor according to the embodiment.

An embodiment of the present invention is described below in detail with reference to accompanying drawings. FIGS. 1A and 1B show external oblique views of a power resistor (hereafter, also referred to as resistor) according to an embodiment, wherein FIG. 1A is an external oblique view of the resistor when viewed from the front, and FIG. 1B is an external oblique view of the resistor when viewed from the back. FIG. 2 is a perspective view showing an internal structure of the resistor according to the embodiment.

A resistor 1 according to the embodiment is a high power resistor having a rated power of 100 W, for example, and has a structure including a resistor main body 3 entirely covered by insulating resin (also referred to as mold resin or armoring resin), such as epoxy resin except for the undersurface of a resistor substrate 21, and paired harness wires 7*a* and 7*b* pulled out from the resistor main body 3.

As shown in FIG. 2, the resistor substrate 21 includes paired electrodes 17*a* and 17*b* formed on a surface of an insulating substrate 15 having a rectangular parallelepiped shape, which is made of alumina etc., and a resistive element 13 formed between these electrodes; wherein these electrodes 17*a* and 17*b* and the resistive element 13 etc. are covered by an insulating protective film, which is omitted from FIG. 2.

The electrodes 17*a* and 17*b* are made of a metal material such as a silver based alloy or a palladium-silver based alloy; wherein the palladium-silver based alloy is preferably a palladium-rich alloy. Moreover, the resistive element 13 may be a thick film resistor made of a ruthenium oxide based material, for example, and be formed through screen printing etc. Note that the pattern shape of the resistive element 13 will be described later.

The back of the insulating substrate 15 is exposed to the outside of the resistor main body 3, as shown in FIG. 1B. Moreover, an attaching hole 5 that passes through between the front and the back surface of the resistor main body 3 is formed near the end part on the opposite side to the resistor substrate 21 of the resistor main body 3. The attaching hole 5 is a through-hole for fastening a screw when attaching the resistor 1 to a heat sink or a metal case made up of an aluminum die-cast. For example, as shown in FIG. 2, attaching the resistor 1 to a case 25 of an instrument with a screw 28 allows heat generated by the resistive element 13 of the resistor substrate 21 to flow to the case 25 in which it is installed, resulting in heat radiation. The appearance of the resistor main body 3 has the same size as that of the general-purpose package (TO-247), for example.

The harness wires 7*a* and 7*b* have core wires or metal conductors covered by insulated resin, resulting in secured insulation, and are made up of portions installed in the resistor main body 3 (i.e., portions covered by armoring resin), and portions exposed to the outside of the resistor main body 3. Therefore, even if a harness electric wire comes in contact with another metal part after the resistor has been mounted, no short circuit etc. will occur. Moreover, as shown in FIG. 2, the coated portions of tip parts 8*a* and 8*b* of the harness wires mounted in the resistor main body 3 are removed, and thus the tip parts 8*a* and 8*b* are connected to the respective electrodes 17*a* and 17*b* using solder etc. Furthermore, round terminals 9*a* and 9*b* (ring terminals) are crimped or caulked etc. to the tip parts of the harness wires 7*a* and 7*b* exposed to the outside of the resistor main body 3 so that the harness wires 7*a* and 7*b* can be connected to other electric apparatus, parts, etc. with a screw etc.

Figure 3:
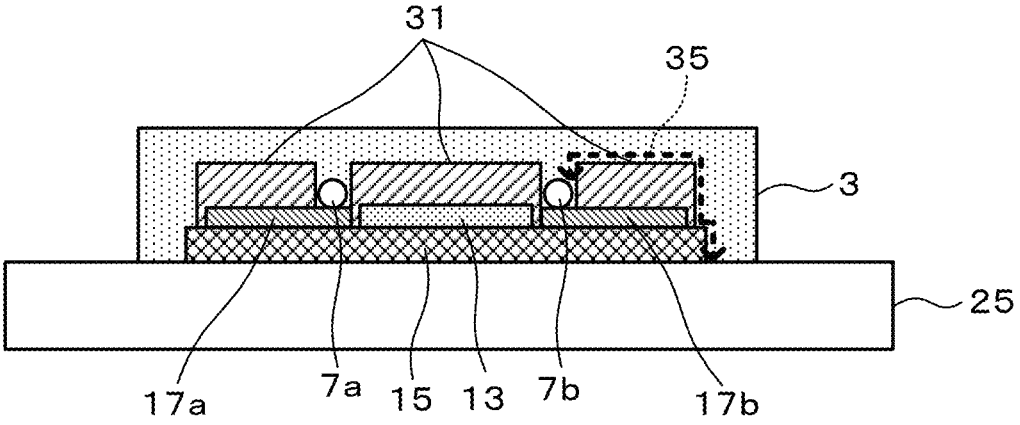
FIG. 3 is a cross-sectional view of a resistor main body when cut along a line A-A' of FIG. 2.
Figure 4:
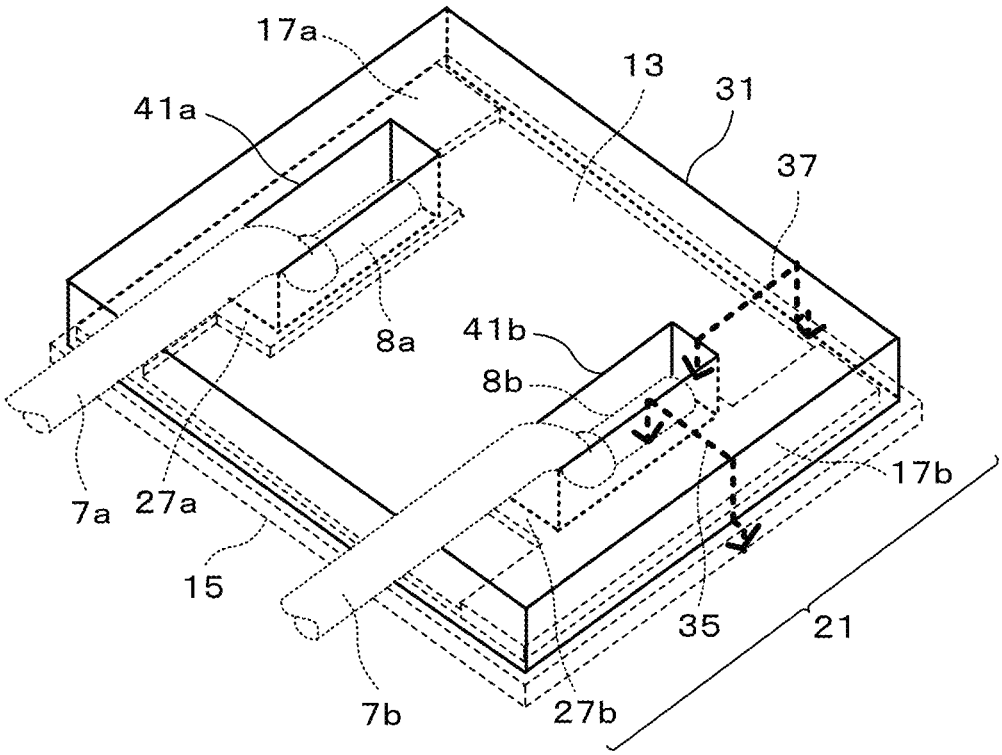
FIG. 4 is an illustration showing the three-dimensional form of a protective film covering a resistor substrate of the resistor according to the embodiment.

A structure of the resistor according to the embodiment for securing insulation between the electric conductor sections (electrodes) of the resistor and the metal case in which the resistor is installed will be described below. FIG. 3 is a cross-sectional view of the resistor main body 3 when cut along the line A-A' of FIG. 2. Moreover, FIG. 4 is an illustration showing the three-dimensional shape of the protective film that covers the resistor substrate 21 of the resistor. Note that a solid line shows the protective film, however, that illustration of mold resin (resistor main body) covering the protective film is omitted in FIG. 4. Moreover, thickness of the protective film in FIG. 4 is illustrated thicker than the actual thickness for convenience of explanation.

In the case where the resistor according to the embodiment is for in-vehicle use, its insulation properties may comply with a public technical standard, such as the Japan Industrial Standard (JIS) "JIS C 60664: Insulation coordination for equipment within low-voltage systems", and the corresponding International Standard "IEC 60664". Accordingly, the resistor of the embodiment has convex parts 27*a* and 27*b* formed by making respective parts of the electrodes 17*a* and 17*b* project inward of the insulating substrate 15 and defining these convex parts 27*a* and 27*b* as junctions with the tip parts 8*a* and 8*b* of the harness wires so as to secure creepage distance of insulation, which is the minimum distance along the surface of an insulator located between two electric conductor sections, namely, a predetermined creepage distance of insulation between the metal case in which the resistor is installed and the electric conductor sections of the resistor.

Furthermore, as shown in FIGS. 3 and 4, the resistor according to this embodiment has a protective film 31 formed by printing glass on other areas than the junctions of the convex parts 27*a* and 27*b* of the electrodes 17*a* and 17*b* with the harness wires. That is, the protective film 31 is a glass coating that covers the entire upper surface of the insulating substrate 15, however, since no coating is formed on the junctions of the convex parts 27*a* and 27*b*, holes 41*a* and 41*b* having a rectangular parallelepiped shape, for example, are formed at the junctions, as shown in FIG. 4.

According to the above-mentioned JIS standard saying "creepage distance of insulation is along the contour of a groove", as shown by thick dotted lines 35 and 37 in FIGS. 3 and 4, the creepage distance of insulation between the metal case in which the resistor according to the embodiment is installed and the conductor sections of the resistor is defined as the minimum distance to the undersurface of the insulating substrate 15 from the electric conductor sections within the holes 41*a* and 41*b* of the protective film 31, such as the tip parts 8*a* and 8*b* of the harness wires, along the upper and the side surface of the protective film 31.

Since the portions along the above-described paths in which the protective film 31 exists allow securing of creepage distance of insulation due to the thickness of the protective film 31, electrodes are then formed at positions at least 1.0 mm distant including thickness of the insulating substrate 15 (e.g., 0.8 mm) from the undersurface of the insulating substrate 15, that is, from the portion where the resistor is mounted, so as to secure creepage distance of insulation for an applied voltage of 450V (effective value) to the electrodes. It is preferable to form the electrodes at positions at least 3.2 mm distant from the undersurface of the insulating substrate 15, so as to secure creepage distance of insulation for an applied voltage of 1000V (effective value) to the electrodes.

Figure 5A:
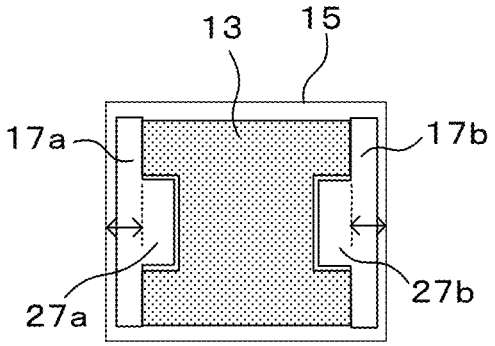
Figure 5B:
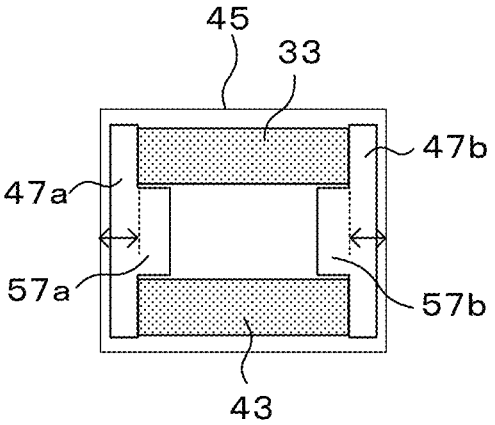
Figure 5C:
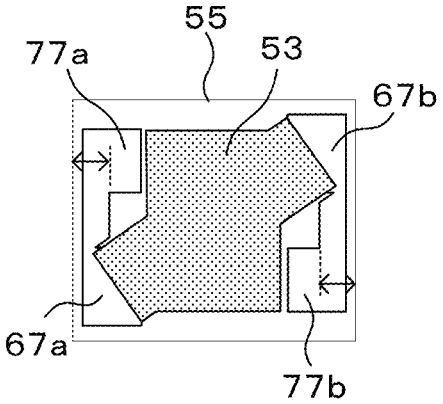

FIGS. 5A to 5C show example forms of the electrodes and the resistive element that secure the above-described creepage distance of insulation. All examples of electrode forms shown in FIGS. 5A, 5B, and 5C have convex parts (portions to be joined together with the respective tip parts of harness electric wires through soldering, welding, etc.) extending inward of the insulating substrate, and have a structure in which other than the convex parts are covered by a protective film.

Of the example shown in FIG. 5A, the electrodes 17*a* and 17*b* formed on the insulating substrate 15 have convex parts 27*a* and 27*b* that have respective central parts projecting inward of the insulating substrate 15, and a rectangular resistive element 13 is formed between the electrodes 17*a* and 17*b*. According to the example of FIG. 5B, electrodes 47*a* and 47*b* formed on an insulating substrate 45 have respective convex parts 57*a* and 57*b* projecting inward of the insulating substrate 45, and rectangular resistive elements 33 and 43 are formed between the longitudinal end parts of the respective electrodes 47*a* and 47*b*. Moreover, FIG. 5C illustrates an example form in which electrodes 67*a* and 67*b* formed on an insulating substrate 55 have convex parts 77*a* and 77*b* at one end parts of the electrodes that project inward of the insulating substrate 55, and an almost rectangular resistive element 53 having a projecting part is formed straddling diagonally between the other end parts of the electrodes 67*a* and 67*b*.

As such, the structure of joining together the harness wires with the convex parts of the electrodes deployed inside of the insulating substrate but avoiding the end part of the insulating substrate allows securing of a sufficient area for the electrodes, and in addition allows securing of a sufficient space for soldering at the junctions with the harness wires. As indicated by arrows in FIGS. 5A, 5B, and 5C, creepage distance of insulation may be secured between each junction, which is an electric conductor section of the resistor, and corresponding side of the insulating substrate.

Figure 6:
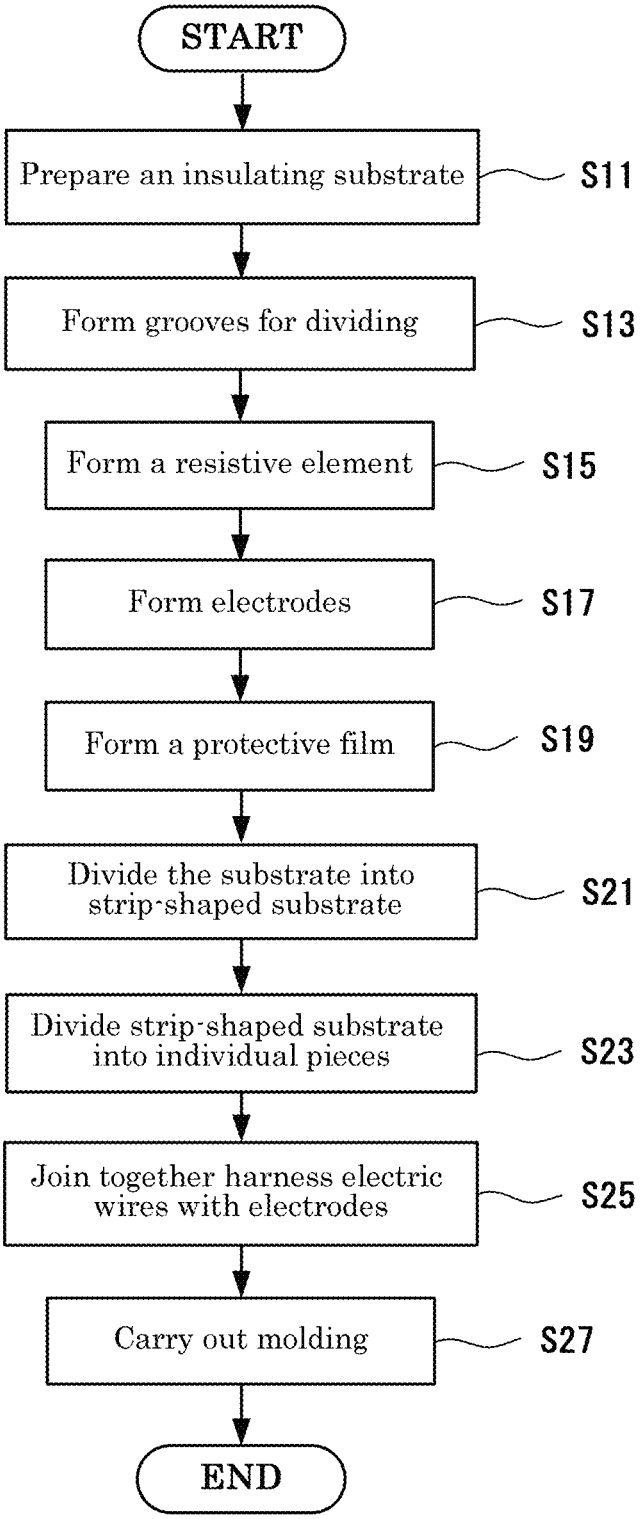
FIG. 6 is a flow chart showing a manufacturing process of the resistor of the embodiment in time series.

A manufacturing process of the resistor according to the embodiment is described below. FIG. 6 is a flow chart showing the manufacturing process of the resistor according to the embodiment in time series. In the first step S11, an insulating substrate for the resistor is prepared. Here, a large-sized insulating substrate such as an alumina substrate having excellent electric insulation and thermal conductivity, which provides many chips, is prepared. In the subsequent step S13, grooves for dividing the substrate, that is, grooves for primary dividing and grooves for secondary dividing are formed on each of the front and the back surface of the insulating substrate prepared in the above step.

In step S15, the specific patterned resistive elements shown in FIGS. 5*a*, 5*b*, and 5*c* are formed by screen printing and firing (sintering) a resistive paste. In the subsequent step S17, paired electrodes having the forms shown in FIGS. 5A, 5B, and 5C are subjected to screen printing and sintering with respect to the resistive elements formed in the above step S15. An electrode paste, such as a silver (Ag) based material or a silver-palladium (Ag—Pd) based material referred above, is used as the electrode material.

In Step S19, a protective film is formed. Here, as shown in FIGS. 3 and 4, the protective film is formed by printing glass so as to cover the entire upper surface of the insulating substrate in which the resistive element etc. have been formed. At this time, no glass is printed on portions to be used as junctions between the harness electric wires and the convex parts of the electrodes, but a hole having a rectangular parallelepiped shape, for example, is instead formed in a portion of the protective film under which the above-described junctions exist. Moreover, the thickness of the protective film allows adjustment of the distance between the metal case in which the resistor is installed and the junctions (electric conductor sections of the resistor), so as to secure creepage distance of insulation described above.

In step S21, primary dividing is carried out along dividing lines made up of grooves running in one direction prepared on the substrate in advance, so that the substrate is divided into strip-shaped substrates. In the subsequent step S23, secondary dividing is carried out on the strip-shaped substrate along the grooves prepared beforehand in the perpendicular direction to the above described one direction so as to divide the resistor into individual pieces.

In step S25, harness electric wires are prepared in which ring terminals are attached to respective one end parts, coatings of the other end parts are partially removed by only a predetermined length, and the other end parts of the harness electric wires (tip parts 8*a* and 8*b* of the harness electric wires) are guided into respective rectangular parallelepiped holes (indicated by symbols 41*a* and 41*b* in FIG. 4) formed in the protective film. The tip parts 8*a* and 8*b* of the harness electric wires are then joined together with the junctions on the electrodes by soldering or welding. Note that since the harness electric wires each have a structure in which metal electric wires are covered by insulating resin so that bending is easy, they can easily follow the shapes of the holes 41*a* and 41*b* of the protective film 31 when and after connected with the junctions, as shown in FIG. 4.

In the last step S27, molding is carried out, the upper and the side surface of the resistor substrate are entirely covered by insulating resin, such as epoxy resin, except that only the undersurface is exposed, and the above-mentioned through-hole for screwing down is formed.

Note that while electrodes are formed after a resistive element has been formed in the above-described example, the resistive element may alternatively be formed after forming the electrodes. Moreover, in a process after the resistive element has been formed, resistance adjustment (trimming) of the resistive element may be carried out by measuring the resistance between the electrodes, for example, and making a cut in the resistive element pattern by a laser beam, sandblasting, etc. according to the measured resistance.

As described above, the resistor according to the embodiment allows not only provision of a sufficient resistive element area but also creepage distance of insulation between the metal case in which the resistor is installed and the electric conductor sections of the resistor by preparing junctions on the electrodes formed further inward than the ends of the insulating substrate with the harness electric wires and forming the protective film made of glass over other areas on the insulating substrate than the junctions. Moreover, a low-profile resistor that requires a smaller mounting area and has excellent heat dissipation performance is provided by lowering the thermal resistance using a thinner insulating substrate.

As a result, since a sufficient heat dissipation design, which allows effective release of the heat generated by the resistor to where it is mounted, and an insulating design with improved safety are attained, and coordination of insulation specified by a public technical standard can be attained, a resistor suitable for continuous discharge resistors used in a vehicle for which heat dissipation design is particularly difficult may be provided.

Moreover, as for the protective glass film formed on the insulating substrate, only junctions with the harness electric wires are exposed, and the other areas are covered by the protective film. As a result, an insulation problem, such that solder adheres to the resistive element when soldering the harness electric wires to the junctions, may be prevented from occurring. Furthermore, in order to electrically connect the resistor and an external device, etc., the harness electric wires covered by resin are adopted, and thus securing insulation between terminals, such as metal lead terminals of a conventional resistor, is unnecessary. This allows a mutually closer interconnection structure etc. between the harness electric wires in a device that cannot secure a sufficient space, resulting in an improved degree of freedom of mounting the resistor.

<Modifications>

The present invention is not limited to the above-described embodiment, and various modifications thereof are possible. For example, forms of the electrodes and the resistive elements for securing creepage distance of insulation in the resistor according to the embodiment are not limited to the examples shown in FIGS. 5A, 5B, and 5C.

Figure 7:
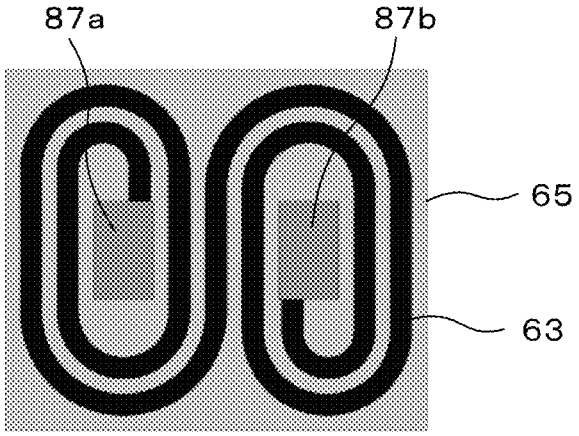
FIG. 7 is an illustration showing a form of the resistive element according to a modification of the embodiment.

FIG. 7 shows a form of the resistive element according to a modification, wherein a resistive element 63 is formed across the entire insulating substrate 65, surrounding the outer circumference of the electrodes 87*a* and 87*b*. The resistive element 63 has a unicursal pattern (meandering pattern) of meander wiring, and its spiral pattern has no edges at which concentration of current occurs and thereby concentration of heat occurs, resulting in dispersion of the heat generated by the resistive element 63 over the insulating substrate 65 (hot spots are dispersed). Furthermore, when an unexpected overcurrent flows through the resistive element 63, a part of the resistive element may be disconnected, thereby interrupting electric current immediately. Moreover, sufficient resistive element area is secured by arranging the resistive element 63 further outward than the electrodes 87*a* and 87*b* even if these electrodes are formed inside of the insulating substrate.

Figure 8A:
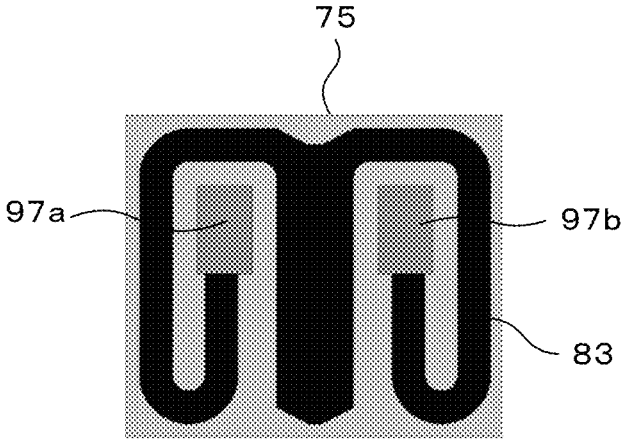
Figure 8B:
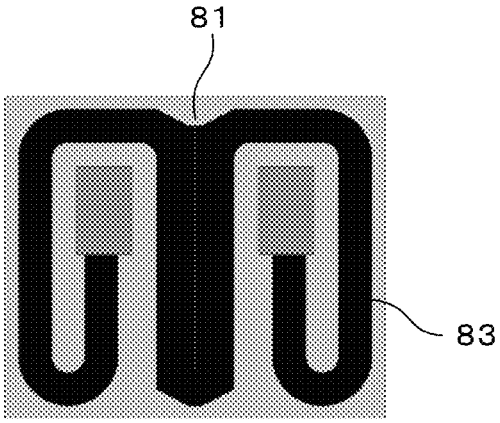

FIGS. 8A and 8B show an example resistive element pattern of meander wiring that is adjustable (capable of trimming) in resistance, wherein the electrodes 97*a* and 97*b* are formed further inward than the end parts of the insulating substrate 75. FIG. 8A shows the resistor pattern before trimming, wherein trimming is carried out by making a cut 81 in a part of a resistive element 83, as shown in FIG. 8B. Such trimming allows security of accuracy of resistance, and formation of a part of the meander pattern through trimming. Note that it is possible that a part of the meander pattern is a ladder-shaped resistive pattern, and that the resistance may be adjusted through cutting a step or steps using a laser etc.

Note that since the modifications shown in FIGS. 7, 8A and 8B may provide smaller areas of electrodes than those of the electrode forms shown in FIGS. 5A, 5B, and 5C, holding down the resistor cost is possible in conjunction with the above effect.

Figure 9:
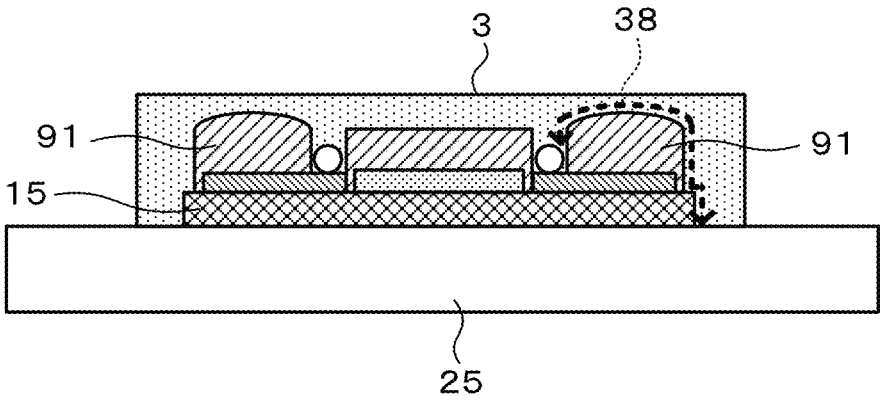
FIG. 9 is an illustration showing another example that secures creepage distance of insulation of the resistor according to the embodiment.
Figure 10:
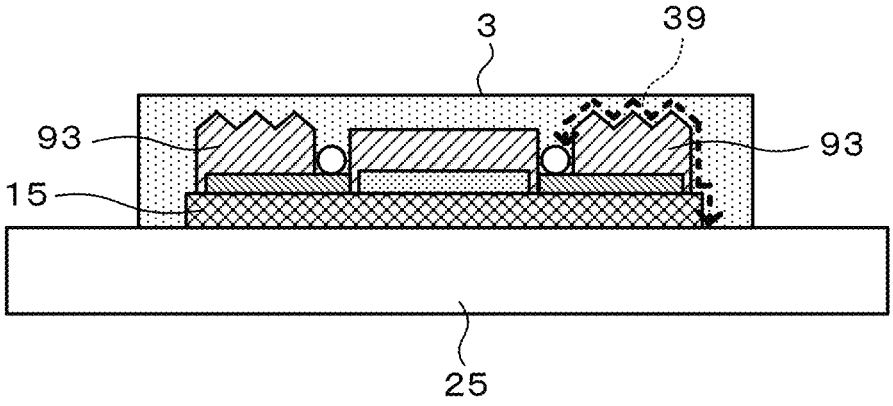
FIG. 10 is an illustration showing yet another example that secures creepage distance of insulation of the resistor according to the embodiment.

On the other hand, the method for securing a predetermined creepage distance of insulation between the metal case in which the resistor is installed and the electric conductor sections of the resistor is not limited to the structure described above (structure depending on the thickness of the protective film). For example, as shown in FIG. 9, the cross-sectional shape of the upper surface of a protective film 91 on the end part side of the insulating substrate 15 may swell upward like a mountain so that a creepage distance of insulation 38 can be secured. Moreover, as shown in FIG. 10, the cross-sectional shape of the upper surface of a protective film 93 on the end part side of the insulating substrate 15 may have several convex parts so that a creepage distance of insulation 39 can be secured. Therefore, distance of the path down to the undersurface of the insulating substrate via the upper and the side surface of the protective film becomes longer so that a desired creepage distance of insulation is secured.

Figure 11:
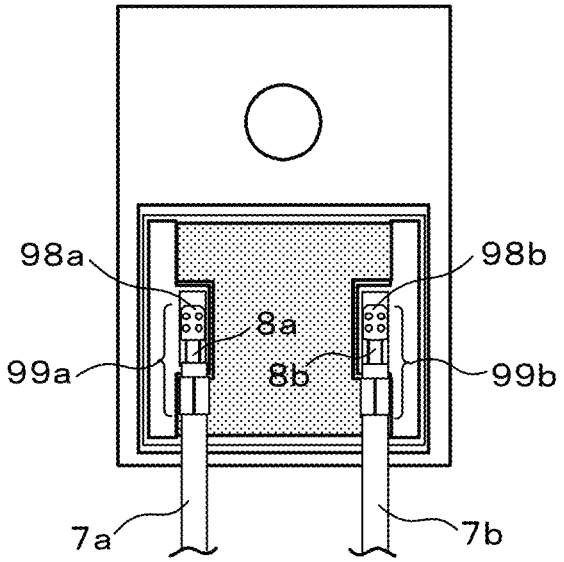
FIG. 11 is an illustration for explaining a structure of the resistor according to the embodiment that secures connection reliability of harness electric wires.

Furthermore, the method for joining the harness electric wires and the electrodes is not limited to the above-described example. For example, as shown in FIG. 11, metal crimp terminals 99*a* and 99*b* are attached to the boundary portions between coated parts and uncoated parts (parts with coating removed) 8*a* and 8*b* of the harness electric wires 7*a* and 7*b*. The metal crimp terminals 99*a* and 99*b* caulk the coated parts, and partially cover the uncoated parts. The portions 98*a* and 98*b* partially covered by these crimp terminals are joined together with the electrodes by soldering or welding. As a result, even if an external pulling force is applied to the harness electric wires, solid connection reliability between the harness electric wires and electrodes against its stress may be secured.

DESCRIPTION OF REFERENCE NUMERALS

1: Resistor
2: Resistor main body
5: Attaching hole

7*a* and 7*b*: Harness electric wires
8*a* and 8*b*: Tip parts of harness wires with coating removed
9*a* and 9*b*: Round terminals (ring terminals)
13, 33, 43, 53, 63, and 83: Resistive elements
15, 45, 55, 65, and 75: Insulating substrates
17*a*, 17*b*, 47*a*, 47*b*, 67*a*, 67*b*, 87*a*, 87*b*, 97*a*, and 97*b*: Electrodes
21: Resistor substrate
25: Case of other instrument
27*a*, 27*b*, 57*a*, 57*b*, 77*a*, and 77*b*: Convex parts
28: Screw
31, 91, and 93: Protective films
35, 37, 38, and 39: Creepage distance for insulation
41*a* and 41*b*: Holes
81: Cut
99*a* and 99*b*: Crimp terminals

The invention claimed is:

1. A resistor comprising:

a resistor substrate that comprises paired electrodes and a resistive element formed on an insulating substrate, an insulating exterior material that covers an upper surface and a side surface of the resistor substrate, wherein an undersurface of the resistor substrate is not covered by the insulating exterior material, and a pair of externally connecting electric conductors that have connector end parts connected to the respective paired electrodes, and other end parts passing through the exterior material and extending outside of the exterior material;

wherein the paired electrodes are formed on areas other than end parts of the insulating substrate, and wherein junctions of the connector end parts of the paired externally connecting electric conductors and the paired electrodes are at positions where a creepage distance of insulation from the junctions to a lowermost surface of the insulating substrate is a predetermined distance or longer.

2. The resistor according to claim 1, wherein the predetermined distance is a minimum distance that secures electric insulation between the junctions and an external conductor coming in contact with the bottom of the insulating substrate.

3. The resistor according to claim 1, wherein the junctions are convex parts, which are respective parts of the paired electrodes projecting inward of the insulating substrate.

4. The resistor according to claim 1, wherein the resistive element is formed having a shape corresponding to shapes of the paired electrodes and straddling between the paired electrodes.

5. The resistor according to claim 1, wherein the upper surface of the resistor substrate is covered by an insulating protective film except for the junctions, and the creepage distance of insulation is a distance from the junctions to the lowermost surface of the insulating substrate via the insulating protective film.

6. The resistor according to claim 5, wherein the creepage distance of insulation is secured by thickness of the insulating protective film or a cross-sectional shape of the upper surface of the insulating protective film.

7. The resistor according to claim 5, wherein the insulating protective film comprises glass.

8. The resistor according to claim 1, wherein the paired externally connecting electric conductors are flexible harness electric wires comprising leads covered by an insulating coating.

9. The resistor according to claim 1, wherein the insulating exterior material has holes formed therein which extend downwardly from a top surface level of the exterior material to the paired electrodes, where the paired electrodes are at positions inside of the holes, and wherein the paired externally connecting electric conductors extend upwardly from the electrodes to the top surface level of the exterior material, and extend outside of the exterior material.

10. A resistor comprising:

a resistor substrate that comprises paired electrodes and a resistive element formed on an insulating substrate, an insulating exterior material that covers at least an upper surface and a side surface of the resistor substrate, and a pair of externally connecting electric conductors that have connector end parts connected to the respective paired electrodes, and other end parts passing through the exterior material and extending outside of the exterior material;

wherein the paired electrodes are formed on areas other than end parts of the insulating substrate, wherein junctions of the connector end parts of the paired externally connecting electric conductors and the paired electrodes are at positions where a creepage distance of insulation from the junctions to a lowermost surface of the insulating substrate is a predetermined distance or longer, and wherein the resistive element is formed surrounding outer circumferences of the paired electrodes.

11. The resistor according to claim 10, wherein the resistive element has a spiral form without any corners.

* * * * *